US006296080B1

(12) United States Patent
Draper et al.

(10) Patent No.: US 6,296,080 B1
(45) Date of Patent: Oct. 2, 2001

(54) VARIABLE TRACTION MECHANISM FOR ROTARY ACTUATED OVERSPEED SAFETY DEVICE

(75) Inventors: James M. Draper, East Hartland; Richard E. Kulak, Bristol, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/598,598

(22) Filed: Jun. 21, 2000

(51) Int. Cl.[7] ..... B66B 5/04
(52) U.S. Cl. ..... 187/376; 187/373; 188/188
(58) Field of Search ..... 187/373, 374, 187/375, 376; 188/180, 188, 189

(56) References Cited

U.S. PATENT DOCUMENTS 2,931,466 * 4/1960 Allenbaugh ..... 188/188
5,065,845 * 11/1991 Pearson ..... 187/89
5,377,786 1/1995 Nakagawa ..... 187/287
6,082,506 * 7/2000 Huang et al. ..... 187/376

FOREIGN PATENT DOCUMENTS 5-262472 * 10/1993 (JP) .

* cited by examiner

*Primary Examiner*—Thomas J. Brahan

(57) ABSTRACT

In an elevator safety braking device, a variable traction mechanism in a rotary actuator allows the drive wheels of the rotary actuator to operate at a reduced preload during normal elevator operation. When engaging, a higher preload is necessary. In the event of safety braking, the variable traction mechanism increases the preload on the drive wheel to ensure timely and proper safety engagement. The variable traction mechanism therefore allows the drive wheels to be subjected to a reduced preload during normal operation, thus relaxing the design criteria for the drive wheels while maintaining reliability.

4 Claims, 3 Drawing Sheets

VARIABLE TRACTION MECHANISM FOR ROTARY ACTUATED OVERSPEED SAFETY DEVICE

FIELD OF THE INVENTION

This invention relates to elevator safety braking systems, and in particular, to a variable traction mechanism for a rotary actuator that reduces the required preload on the actuator.

BACKGROUND OF THE INVENTION

Elevator systems generally include an elevator car suspended by a rope (as wire cables are called within the elevator industry) or coated steel belt system. The car is guided along guide rails within an elevator hoistway so that relatively little lateral motion is imparted to the car during use. Passenger elevators are required to have a braking system to halt the elevator car in an overspeed event. Such a braking system is commonly activated by an actuation device known as a governor. The governor detects excessive speed of the car and actuates an emergency stop device.

The governor system typically consists of sheaves at the top and bottom of the hoistway with a governor rope reeved in an endless loop over both sheaves. A part of the governor rope is connected to a safety link that is mounted on the elevator car frame. As the car ascends and descends, the governor rope travels with it, rotating the sheaves. One of the sheaves has a centrifugal governor mounted in it, so that when the sheaves rotate too fast, paired flyweights or flyballs rotating on a spindle are accelerated outward by centrifugal force, where they trip an overspeed switch, thus cutting power to the elevator drive motor. If further overspeed occurs, a clamping device is actuated that clamps onto the governor rope to activate the braking safeties, bringing the elevator car to a safe albeit abrupt stop.

More modern systems omit the stationary governor pulley and rope combination by fitting each elevator car with its own governor, such as that disclosed in U.S. Pat. No. 5,377,786 (Nakagawa) or in U.S. patent application Ser. No. 09/428,023 filed on Oct. 27, 1999 and entitled ROTARY ACTUATED OVERSPEED SAFETY DEVICE, incorporated herein by reference.

SUMMARY OF THE INVENTION

Briefly stated, in an elevator safety braking device, a variable traction mechanism in a rotary actuator allows the drive wheels of the rotary actuator to operate at a reduced preload during normal elevator operation. When engaging, a higher preload is necessary. In the event of safety braking, the variable traction mechanism increases the preload on the drive wheel to ensure timely and proper safety engagement. The variable traction mechanism therefore allows the drive wheels to be subjected to a reduced preload during normal operation, thus relaxing the design criteria for the drive wheels while maintaining reliability.

According to an embodiment of the invention, a variable traction mechanism includes a rotary actuator; first and second wheels pivotably connected to an elevator car via first and second linking members, respectively; the first and second wheels riding on opposing sides of a guide rail for the elevator car; the rotary actuator including means for sensing when the first wheel exceeds a predetermined speed of rotation and locking the first wheel to the rotary actuator; a first spring acting between the second wheel and a first pivot point on the rotary actuator; a second spring acting between a center of the second wheel and a second pivot point on the rotary actuator; and wherein the first and second pivot points are located such that a friction force between the first wheel and the guide rail times a length of a normal to a direction of the friction force passing through a center of the first wheel plus a second spring force of the second spring times a length of a normal to a direction of the second spring force passing through the center of the first wheel is greater than a first spring force times a length of a normal to a direction of the first spring force of the first spring passing through the center of the first wheel.

DETAILED DESCRIPTION OF THE PREFERRED EMBODIMENT

Figure 1:
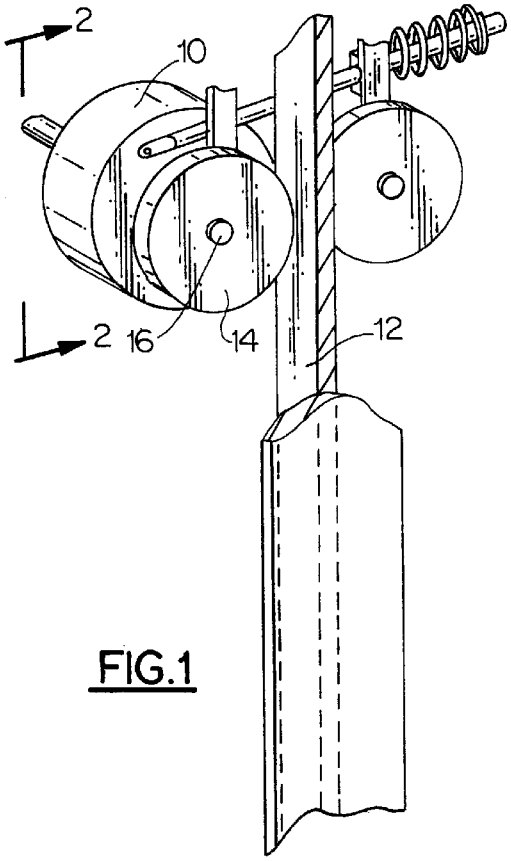
FIG. 1 shows a rotary actuator and actuator drive wheel connected to an elevator car guide rail.

Referring to FIG. 1, a rotary actuator 10 preferably of the centrifugal force type is operatively connected to an elevator car guide rail 12 by an actuator drive wheel 14. A shaft 16 of actuator drive wheel 14 is preferably also the shaft inside actuator 10, but may be connected in an any conventional manner.

Figure 2:
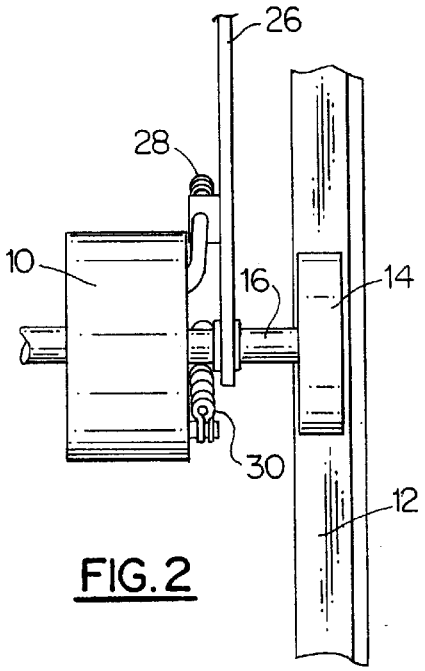
FIG. 2 shows a side view of the rotary actuator and actuator drive wheel of FIG. 1.
Figure 3:
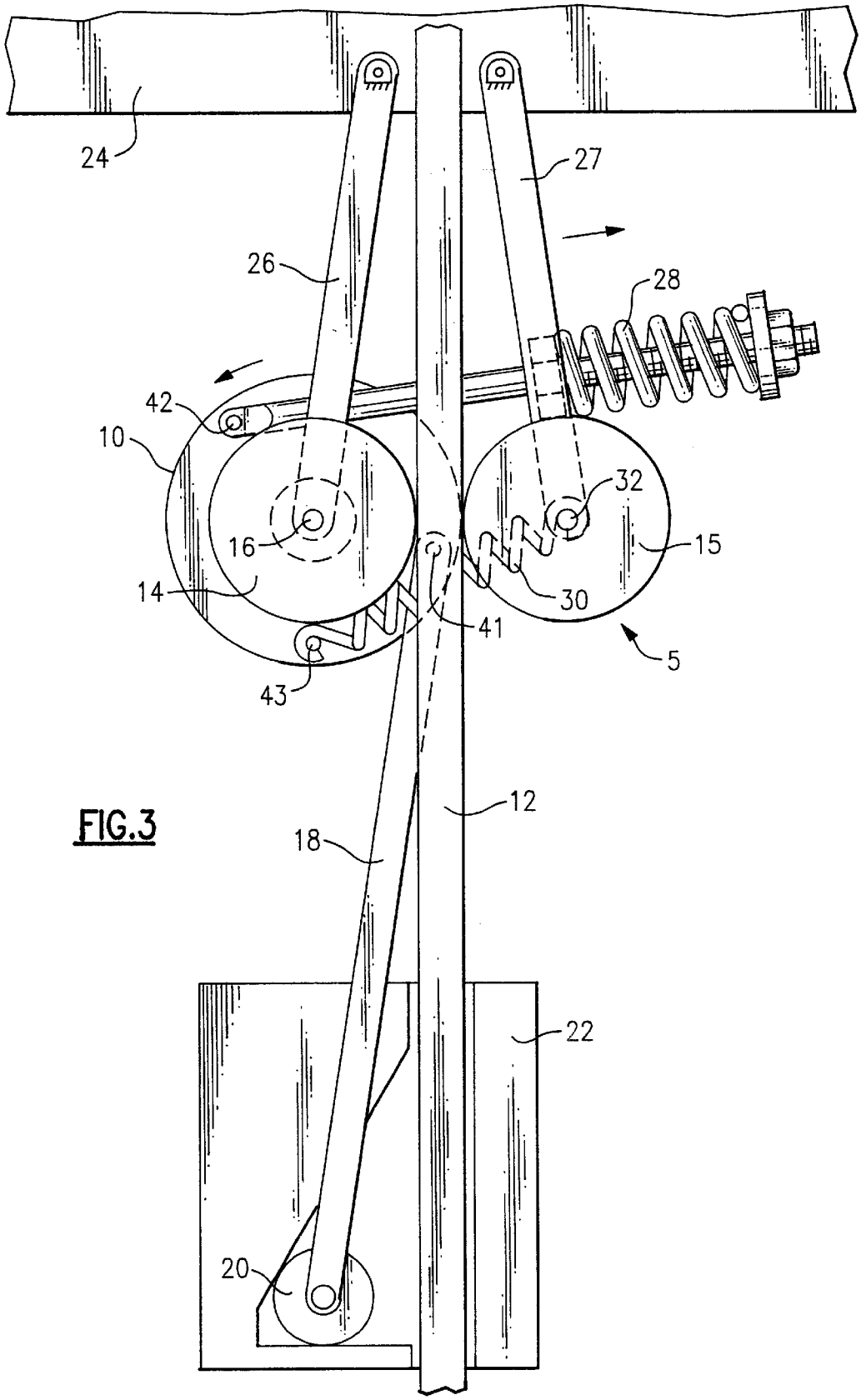
FIG. 3 shows a variable traction mechanism according to an embodiment of the present invention.

Referring to FIGS. 2–3, a variable traction mechanism is shown generally at 5. A lift rod 18 is operatively connected at one end to actuator 10 and at another end to a safety roller 20 at a pivot point 41. Safety roller 20 is inside a safety block 22. Actuator drive wheel 14 and a second drive wheel 15 are connected to an elevator car 24 by two pivoting linking members 26, 27. During normal operation, rotary actuator 10 freewheels when elevator car 24 travels at less than a predetermined safety tripping speed. If elevator car 24 reaches the safety tripping speed, actuator 10 locks to actuator drive wheel 14, which pulls up lift rod 18 causing safety roller 20 to jam between safety block 22 and car rail 12, thus forcing elevator car 24 to an abrupt stop.

Wheels 14, 15 are preloaded by a first spring 28 so that adequate force is transmitted to safety roller 20 to properly engage the safety. The magnitude of the preload on wheels 14, 15 during routine elevator operation directly affects the required diameter of wheels 14, 15 to achieve acceptable wheel life. First spring 28 is preferably connected through linking member 27 and connects to rotary actuator 10 at a pivot point 42. A second spring 30 is preferably connected between an axle 32 of wheel 15 and a pivot point 43 in rotary actuator 10. Second spring 30 is approximately 1,000 times less stiff than first spring 28. During normal elevator operation, first spring 28 and second spring 30 have approximately the same preload, but the deflection of first spring 28 is minute. Any wear of the mechanisms or variations in the thickness of car rail 12 thus cause negligible rotation of rotary actuator 10, thereby maintaining the proper preload on first spring 28. In operation, if rotary actuator 10 senses an overspeed condition and locks to wheel 14, the load on first spring 28 increases and the load on second spring 30 decreases.

Figure 4:
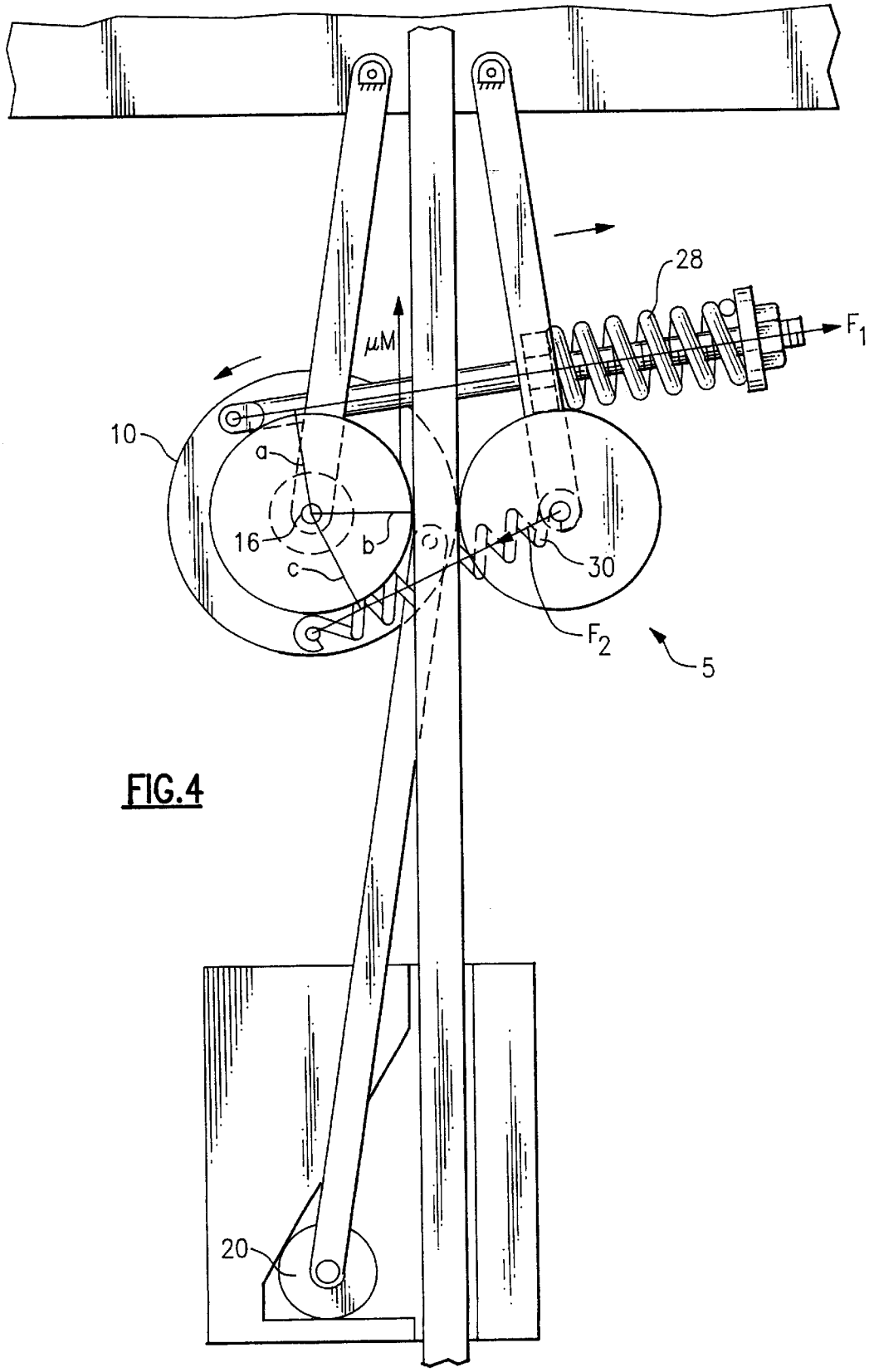
FIG. 4 shows a schematic diagram used to explain the variable traction mechanism of the present invention.

Referring to FIG. 4, the geometry of mechanism 5 is defined such that the friction capability at the wheel-rail interface ensures compression of spring 28 and concurrent lifting of safety roller 20. During application of rotary actuator 10, there is a moment resisting safety engagement and a moment supporting safety engagement. The moment resisting safety engagement is (F1*a), while the moment supporting safety engagement is ($\mu$N*b)+(F2*c), where $\mu$N is the friction force in Newtons, F1 is the spring force of spring 28, F2 is the spring force of spring 30, a is the length of the normal to F1 passing through the center of shaft 16, b is the length of the normal to $\mu$N passing through the center of shaft 16, and c is the length of the normal to F2 passing through the center of shaft 16. The geometry of mechanism 5 is then defined such that the following relationship is always true: ($\mu$N*b)+(F2*c)>(F1*a). As actuator 10 rotates in the direction shown by the arrow, distance a lessens, thus the moment resisting safety engagement decreases as actuator 10 rotates.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A variable traction mechanism, comprising:

a rotary actuator;

first and second wheels pivotably connected to an elevator car via first and second linking members, respectively; said first and second wheels riding on opposing sides of a guide rail for said elevator car;

said rotary actuator including means for sensing when said first wheel exceeds a predetermined speed of rotation and locking said first wheel to said rotary actuator;

a first spring acting between said second wheel and a first pivot point on said rotary actuator;

a second spring acting between a center of said second wheel and a second pivot point on said rotary actuator; and wherein said first and second pivot points are located such that a friction force between said first wheel and said guide rail times a length of a normal to a direction of said friction force passing through a center of said first wheel plus a second spring force of said second spring times a length of a normal to a direction of said second spring force passing through said center of said first wheel is greater than a first spring force times a length of a normal to a direction of said first spring force of said first spring passing through said center of said first wheel.

2. A variable traction mechanism according to claim 1, wherein said first spring force is approximately 1,000 times as great said second spring force.

3. A variable traction mechanism according to claim 1, wherein said rotary actuator is connected to a lift rod for a safety roller of an elevator safety block.

4. A variable traction mechanism according to claim 1, wherein said means for sensing includes a centrifugal force sensor.

* * * * *